US006033263A

United States Patent [19]

Weidler et al.

[11] Patent Number: 6,033,263

[45] Date of Patent: Mar. 7, 2000

[54] ELECTRICALLY CONNECTOR WITH CAPACITIVE COUPLING

[75] Inventors: Charles Harry Weidler, Lancaster; Robert Neil Whiteman, Jr., Middletown, both of Pa.

[73] Assignee: The Whitaker Corporation, Wilmington, Del.

[21] Appl. No.: 08/949,668

[22] Filed: Oct. 14, 1997

Related U.S. Application Data

[60] Provisional application No. 60/027,545, Oct. 15, 1996.

[51] Int. Cl.[7] ..... H01R 13/66

[52] U.S. Cl. ..... 439/620; 439/939; 333/184

[58] Field of Search ..... 439/620, 92, 607, 439/939; 333/181, 185

[56] References Cited

U.S. PATENT DOCUMENTS

| | | | |
|---|---|---|---|
| 4,386,814 | 6/1983 | Asick | 439/607 |
| 4,500,159 | 2/1985 | Briones et al. | 339/147 R |
| 4,643,509 | 2/1987 | Hollyday et al. | 439/607 |
| 4,772,221 | 9/1988 | Kozlof | 439/549 |
| 4,797,120 | 1/1989 | Ulery | 439/578 |
| 4,853,659 | 8/1989 | Kling | 333/184 |
| 4,884,982 | 12/1989 | Fleming et al. | 439/620 |
| 4,931,754 | 6/1990 | Moussie | 333/184 |
| 4,934,960 | 6/1990 | Capp et al. | 439/620 |
| 5,018,989 | 5/1991 | Black et al. | 439/620 |
| 5,062,811 | 11/1991 | Hackman | 439/620 |
| 5,147,224 | 9/1992 | Tan et al. | 439/620 |
| 5,151,054 | 9/1992 | Briones et al. | 439/620 |
| 5,152,699 | 10/1992 | Pfeifer | 439/620 |
| 5,246,389 | 9/1993 | Briones | 439/620 |
| 5,326,280 | 7/1994 | Briones et al. | 439/581 |
| 5,331,505 | 7/1994 | Wilheim | 361/306.3 |
| 5,401,192 | 3/1995 | Briones et al. | 439/639 |
| 5,513,065 | 4/1996 | Caveney et al. | 361/311 |
| 5,554,050 | 9/1996 | Marpoe, Jr. | 439/620 |
| 5,738,541 | 4/1998 | Tseng | 439/567 |
| 5,752,854 | 5/1998 | Capp et al. | 439/607 |
| 5,769,666 | 6/1998 | Wu | 439/620 |
| 5,865,646 | 2/1999 | Ortega et al. | 439/607 |

FOREIGN PATENT DOCUMENTS

| | | | |
|---|---|---|---|
| 0123457 | 3/1983 | European Pat. Off. | 439/620 |

*Primary Examiner*—Steven L. Stephan
*Assistant Examiner*—Michael C. Zarroli

[57] ABSTRACT

Capacitive coupling assembly (60) securable about a shielded connector (10), for isolating the connector shell (14) from a conductive panel (4) after mounting. Coupler (60) includes a dielectric member (61) secured between front and rear conductive sheets (62, 63), and includes a plurality of capacitors (72) held between the sheets and electrically engaged therewith. The dielectric member (61) includes a flange (67) that insulates the connector shell (14) from front conductive sheet (62) and the panel (4) at cutout (5). Front sheet (62) engages the panel (4), and rear sheet (63) engages the connector shell (14) at spring arms (78).

5 Claims, 5 Drawing Sheets

ELECTRICALLY CONNECTOR WITH CAPACITIVE COUPLING

This application claims the benefit of U.S. Provisional Application No. 60/027,545, filed Oct. 15, 1996.

FIELD OF THE INVENTION

The invention relates to an electrical connector which is capacitively coupled to the chassis of an electrical device.

BACKGROUND OF THE INVENTION

Electronic devices such as computers and peripheral equipment generally have at least one onboard electrical connector which serves as an input/output (I/O) port for the device. The I/O connector typically has a shield or shell which is grounded to the chassis of the electronic device for protecting the device against electromagnetic interference and against electrostatic discharge when the device is interconnected with another device by an interconnect cable. However, one of the devices to be connected may be at an elevated ground potential with respect to the other device. Therefore, the devices need to be protected against low frequency current that would flow therebetween due to the unequal ground potential during mating and unmating of the interconnect cable. Each device can be protected by a capacitive coupling between the I/O connector and the chassis of the device which would block passage of low frequency current. The invention provides an I/O connector having a capacitive coupling for protecting against low frequency current.

SUMMARY OF THE INVENTION

The invention is a capacitive coupling assembly for an electrical connector, where the connector comprises a dielectric housing holding a plurality of contacts and a conductive shell on the housing. The capacitive coupling assembly is electrically coupled to the shell, and comprises a dielectric member which is sandwiched between conductive sheets, the dielectric member holding one or more capacitors that are operably connected to effect a capacitance between the conductive sheets, to block low frequency current from electrical potential between the connector shell and a conductive panel to which the connector is to be mounted, at a cutout thereof. One of the conductive sheets engages the panel and first electrodes of the capacitors, and the other conductive sheet engages the connector shell and second electrodes of the capacitors. Preferably, both conductive sheets selfsecure to the dielectric member.

BRIEF DESCRIPTION OF THE DRAWINGS

Embodiments of the invention will now be described by way of example with reference to the accompanying drawings.

DETAILED DESCRIPTION

Figure 1:
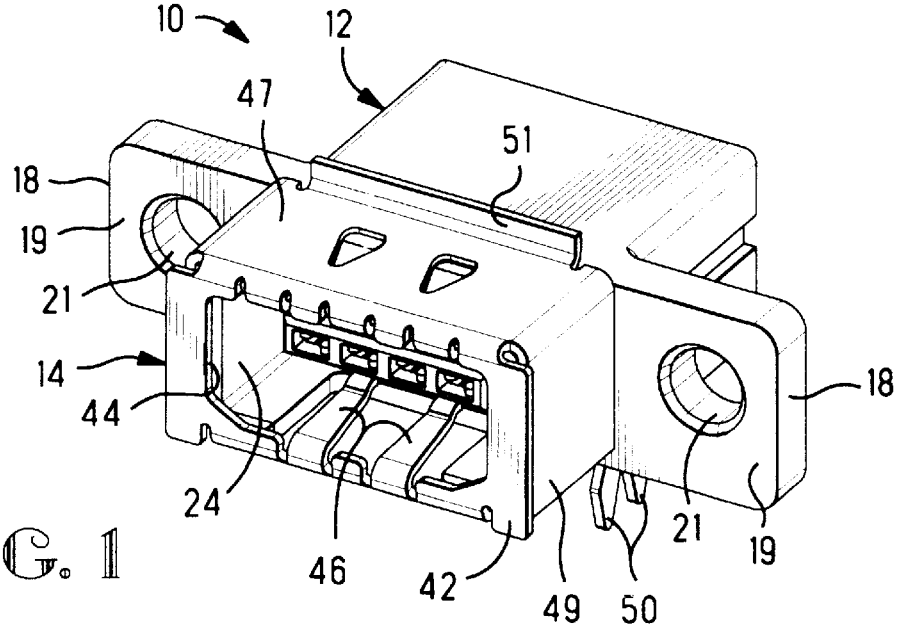
FIG. 1 is an isometric view of an electrical connector which can be used with a capacitive coupling.
Figure 2:
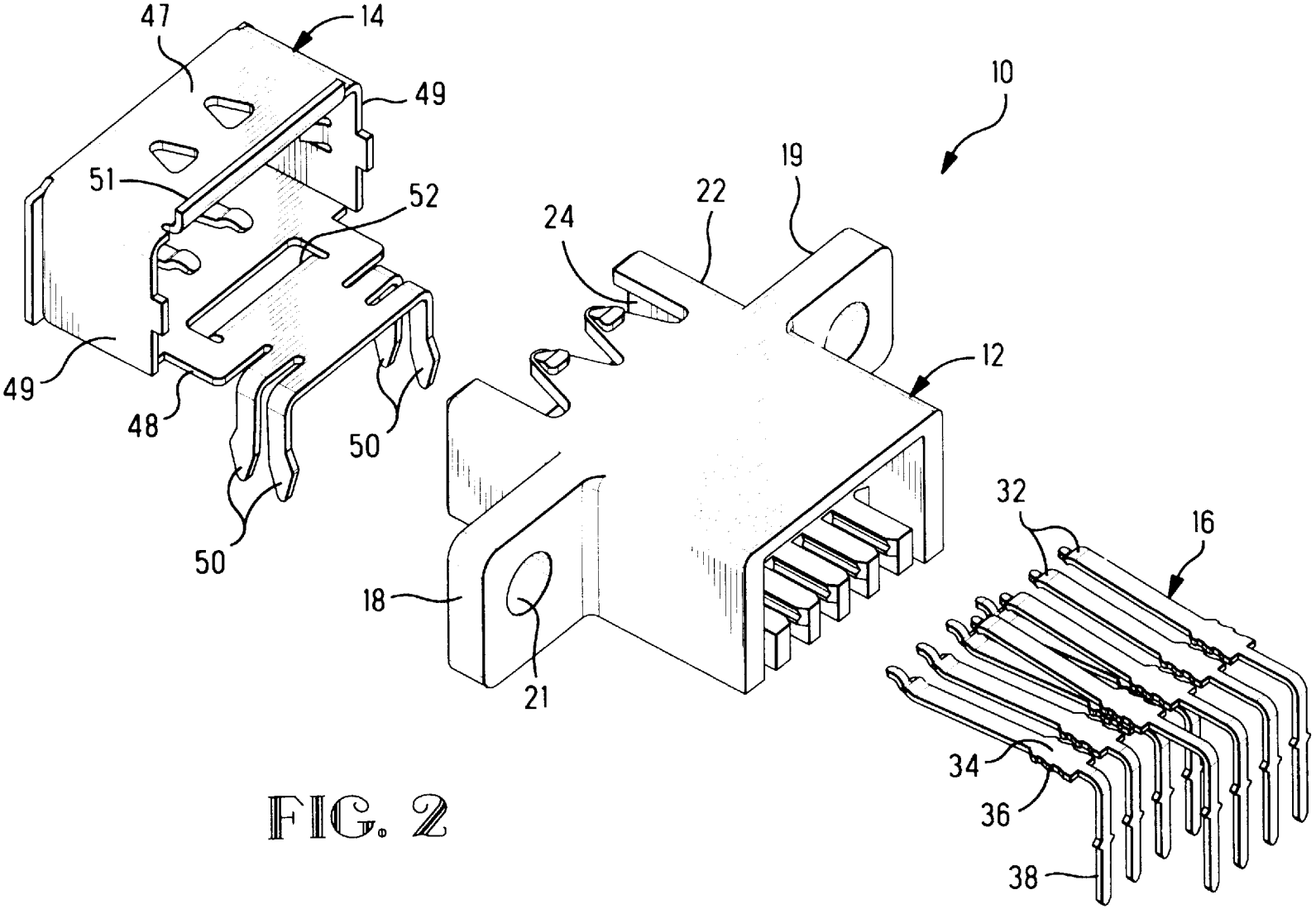
FIG. 2 is an exploded isometric view of the connector.
Figure 3:
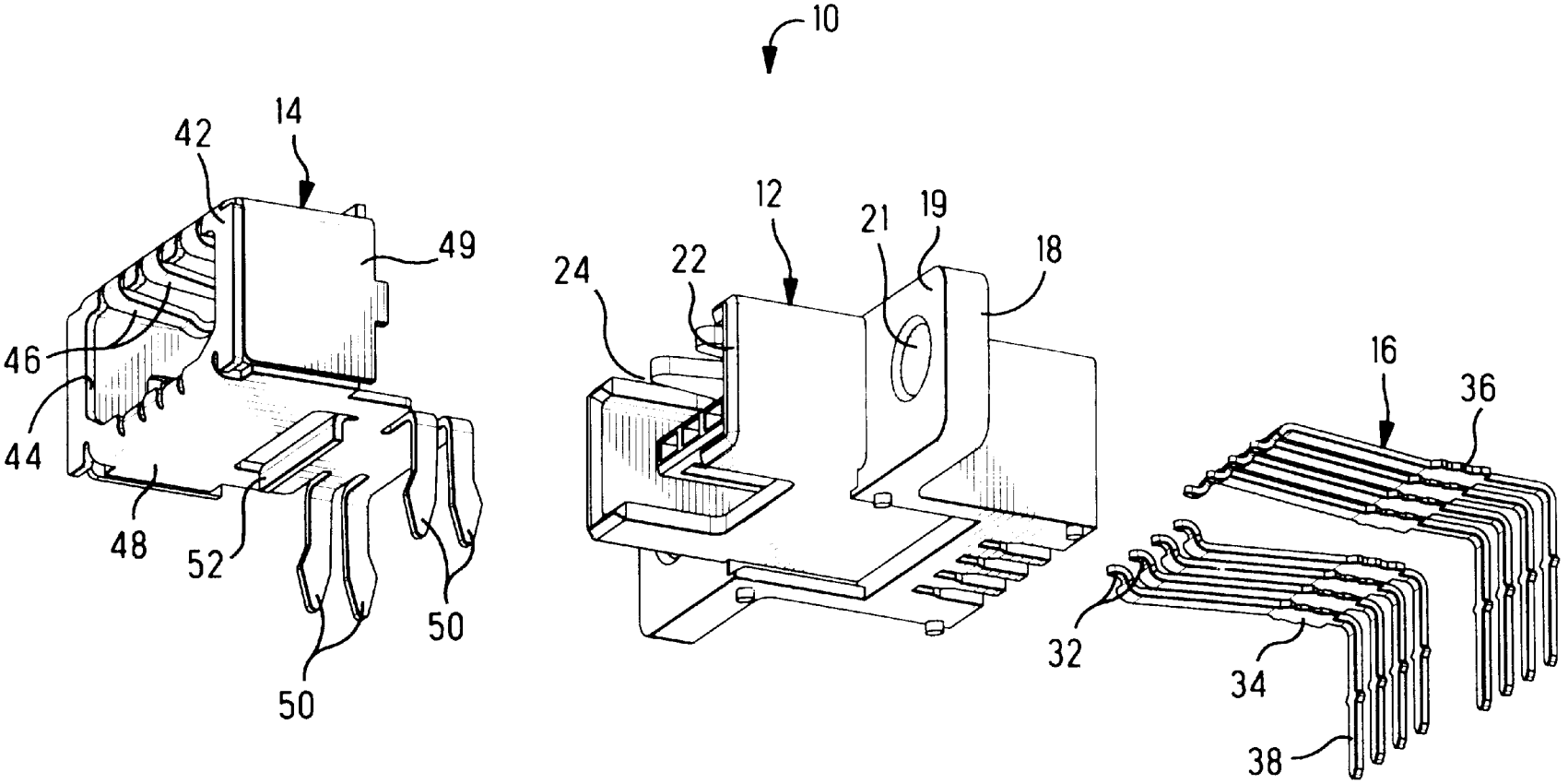
FIG. 3 is an exploded isometric view of the connector from a different angle.

There is shown in FIGS. 1–3 an I/O connector 10 for use with electronic equipment such as a computer and peripheral devices. The connector 10 comprises a dielectric housing 12, a conductive shell 14 and a plurality of contacts 16. The housing 12 has a forward end 22 with a cavity 24 which defines a receptacle for a mating electrical connector such as a connector on the end of an interconnect cable. Each of the contacts 16 has a mating end 32 which is exposed in the cavity 24 for mating engagement with a contact of the mating connector, a retention section 34 with barbed edges 36 to secure the contact in the housing, and a lead 38 which is insertable in a plated through-hole in a circuit board in the electronic equipment. The housing 12 has a pair of mounting pads 18 each with a front face 19 which defines a mounting surface of the connector 10. Each of the mounting pads 18 has a hole 21 for receiving a fastener to connect the housing 12 to a panel of the equipment.

The shell 14 is mounted on the forward end 22 of the housing 12 and has a front face 42 with an opening 44 which is aligned with the entrance to the cavity 24. The shell has resilient arms 46 which extend from the front face 42 into the cavity 24 for engagement with a shell on the mating connector. The shell 14 is stamped and formed from electrically conductive sheet material and includes a top wall 47, a bottom wall 48, and side walls 49 which closely surround the forward end 22 of the housing. Extending from the bottom wall 48 of the shell are two pairs of resilient legs 50 which are engageable in respective holes in the circuit board to secure and support the I/O connector on the circuit board. The shell 14 has an upper flange 51 and a lower flange 52 each with a forward surface which is substantially coplanar with the mounting surfaces defined by the front faces 19 of the mounting pads.

Figure 4:
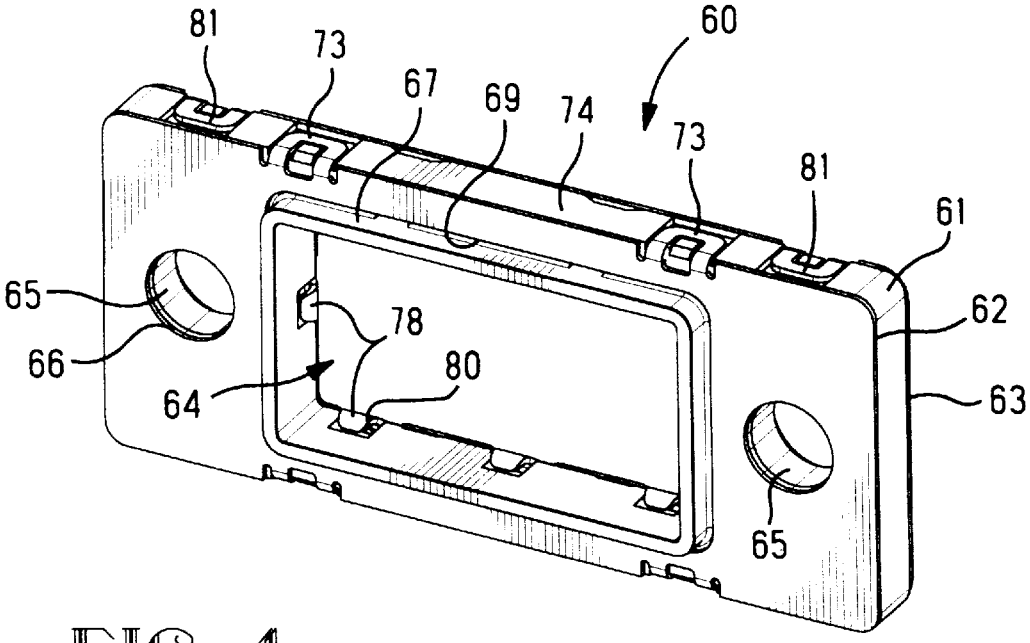
FIG. 4 is an isometric view of a capacitive coupling for use with the connector of FIG. 1.

A capacitive coupling assembly 60 in the form of a gasket is disposed between the I/O connector 10 and the panel of the electronic equipment. As shown in FIG. 4, capacitive coupling 60 comprises a dielectric member 61 which is sandwiched between sheets of conductive material 62, 63. The capacitive coupling has a central aperture 64 which is dimensioned so that the capacitive coupling can be installed on the connector 10 (FIGS. 1–3) with the forward end 22 of the connector including the shell 14 extending through the aperture. The capacitive coupling assembly 60 has through-holes 65 which are alignable with the holes 21 in the mounting pads of the connector to receive the same fasteners which secure the connector to the equipment panel. It should be understood that each hole 66 has a diameter passing through the conductive sheet 62 which is larger than the diameter of the hole 65 passing through the dielectric member 61, in order to avoid contact of the conductive sheet 62 with the fastener received in the hole, for a reason which will become fully apparent hereinafter.

Figure 5:
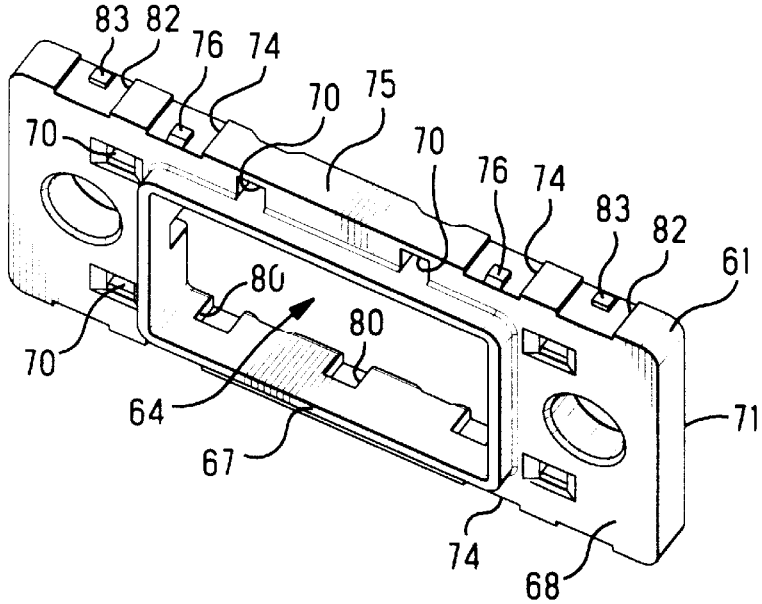
FIG. 5 is an isometric view of a dielectric member used in the capacitive coupling.
Figure 8:
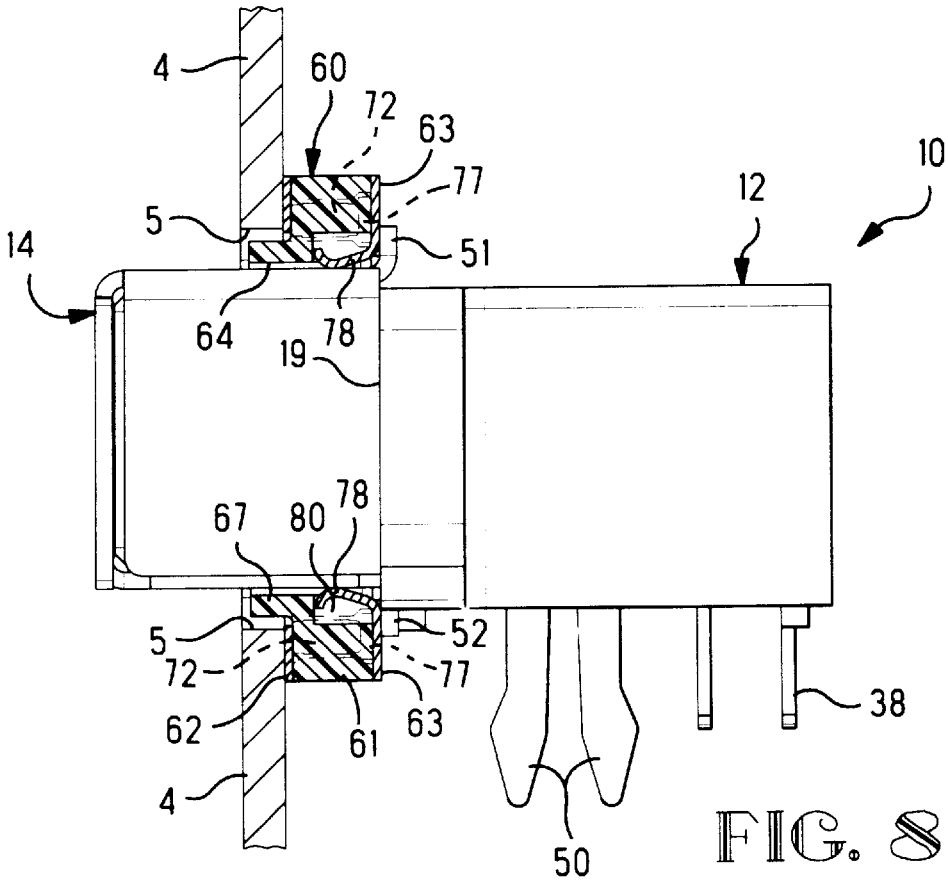
FIG. 8 is a side view of the connector and a cross-sectional view through a portion of the capacitive coupling.
Figure 9:
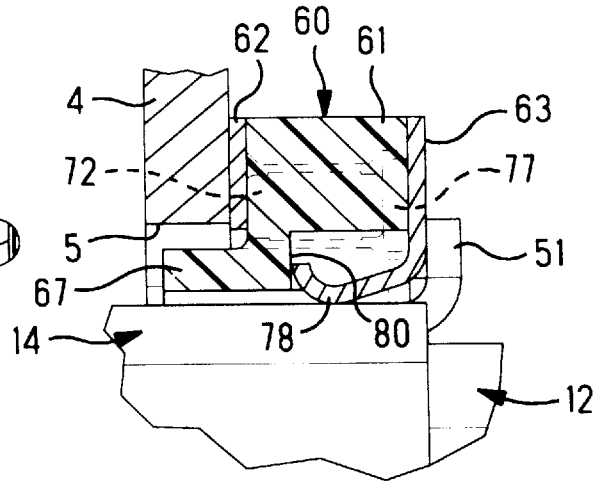
FIG. 9 is an enlarged portion of FIG. 8 showing a dielectric spacer between a shell of the connector and a conductive sheet of the capacitive coupling.

With reference to FIGS. 4 and 5, the dielectric member 61 is preferably made from a rigid plastic material, although an elastomeric material could also be used. Dielectric member 61 is shown to include a flange 67 extending forwardly from front face 68 at the periphery of aperture 64 through a slightly larger cutout 69 of front conductive sheet 62, to extend into the panel cutout (FIGS. 8 and 9). The dielectic member has a number of passageways 70, eight passageways in the present example, which extend between front and back faces 68, 71 of the member 61. Disposed loosely within each of the passageways 70 will be a mini-capacitor 72 of a type which is commercially available in various sizes and capacitances from a number of sources such as from Novacap in Valencia, Calif. (see FIGS. 8 and 9). The capacitors 72 will be oriented so that opposite first and second ends of each capacitor are exposed near the front and back faces of the dielectric member 61, thereby effecting a capacitance between the electrodes defined on the exposed ends of the capacitors.

Figure 6:
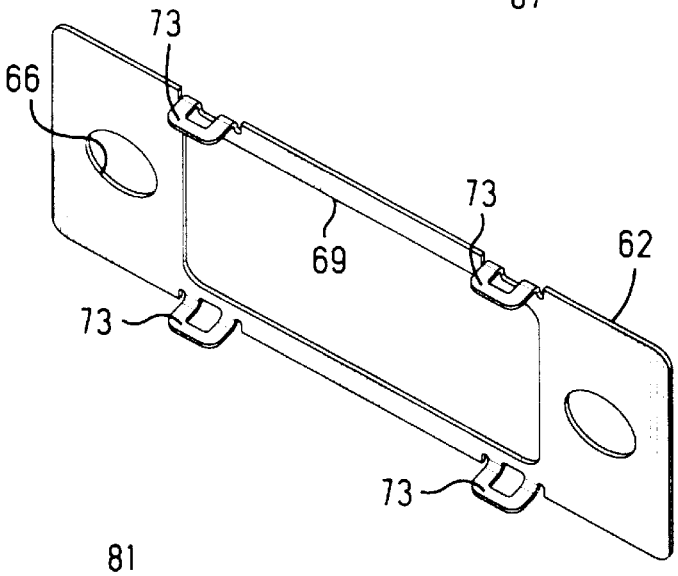
FIGS. 6 and 7 are isometric views of the front and rear conductive sheets of the capacitive coupling.

FIG. 6 illustrates front conductive sheet 62, that is shown to include latch arms 73 extending rearwardly from the outer peripheral edge of the sheet, to be received into recesses 74 along the outer peripheral side surface 75 of dielectric member 61 to latch onto latch projections 76 thereof, thereby selfsecuring to the dielectric member.

Figure 7:
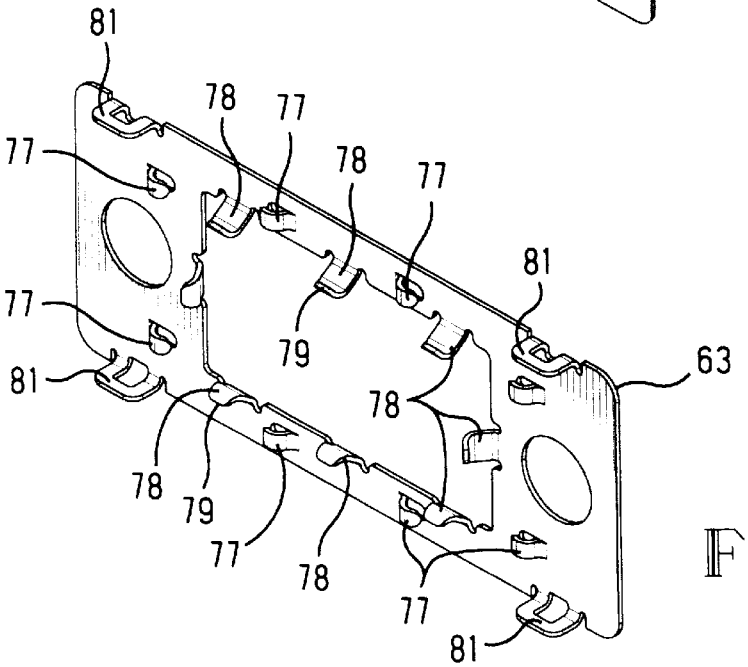

With reference to FIG. 7, the conductive sheet 63 is stamped and formed to have resilient spring fingers 77 and spring arms 78. Spring fingers 77 are arranged to be in registration with the capacitors 72 in the passageways 70 when the conductive sheet 63 is attached to the dielectric member 61. Conductive sheet 63 is adapted to become groundingly engaged to the connector shell 14 by means of spring arms 78 that extend into aperture 64 and are angled forwardly to free ends 79 that will become spring biased against the outer surface of the connector shell 14 when the capacitive coupling assembly is assembled to the connector. Upon such assembly, free ends 79 will be deflected into relief openings 80 in the dielectric member 61 adjacent rear face 71, along aperture 64 (see FIGS. 8 and 9). Rear conductive sheet 63 also includes latch arms 81 extending forwardly from outer peripheral sheet edge to be received into recesses 82 (FIGS. 4 and 5) along the outer peripheral side surface 75 of dielectric member 61 staggered laterally from recesses 74, to become latched to latch projections 83 thereof and thereby selfsecure to the dielectric member.

FIG. 8 is a cross-sectional view showing the connector 10 and the capacitive coupling assembly 60 mounted to an equipment panel 4, with FIG. 9 being an enlarged view of a portion thereof. The forward end of the connector extends through a hole 5 in the panel 4. The conductive sheet 62 of the capacitive coupling is engaged with the panel 4, and the conductive sheet 63 is engaged with the upper flange 51 and the lower flange 52 of the shell 14. Preferably, a key or other polarizing feature is provided to ensure that the capacitive coupling is correctly oriented with the conductive sheet 62 abutting the panel 4. The resilient fingers 77 of the conductive sheet 63 are engaged with the top surface 47 and the bottom surface 48 of the shell. Each spring finger 77 urges the capacitor 72 against the conductive sheet 62, thereby forming an electrical path through the capacitor.

It is preferred that a dielectric spacer be provided to electrically insulate the conductive sheet 62 from the shell 14. The hole 5 in the panel is dimensioned such that there is a gap between the panel 4 and the shell 14 around the entire periphery of the shell, into which is received flange 67 of dielectric member 61 of the capacitive coupling assembly 60. Thus, any difference in ground potential between the shell 14 and the panel 4 is directed through conductive sheet 62 and the capacitors 72 which will block passage of low frequency current.

Figure 10:
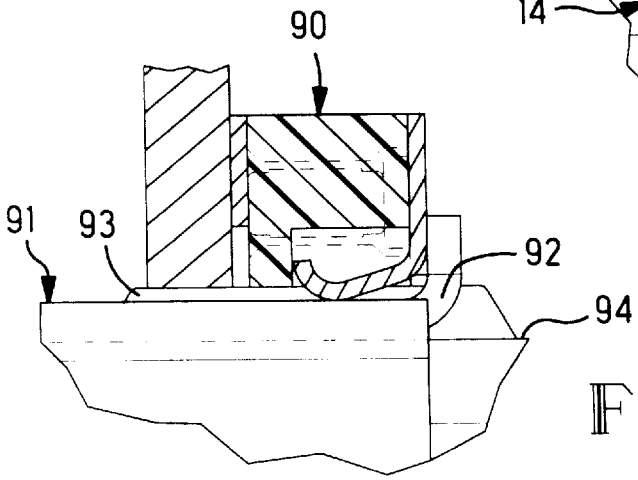
FIG. 10 is an alternate embodiment of a connector with capacitive coupling assembly.

FIG. 10 shows an alternative embodiment of a capacitive coupling assembly 90 and associated connector 91. An insulative gap is assured between the panel and the connector shell 92 by a rib 93 of the connector housing 94 which extends through a slot in the shell 92.

The capacitive coupling of the present invention is useful with a conventional shielded connector without requiring any modification to the connector. Although a capacitive coupling has been described in conjunction with a receptacle connector having a receptacle portion which receives a mating portion of a plug connector, it should be apparent that the capacitive coupling could be readily adapted to various other connector types, and all such adaptations are considered to be within the scope of the invention.

What is claimed is:

1. An electrical connector comprising:

a dielectric housing holding a plurality of contacts, a conductive shell on the housing, and a capacitive coupling assembly electrically coupled to the shell, the capacitive coupling assembly comprising a dielectric member which is sandwiched between front and rear conductive sheets, the dielectric member holding at least one capacitor which is operably connected to effect a capacitance between the conductive sheets, and the rear conductive sheet engages the conductive shell by a plurality of spring arms.

2. The connector as set forth in claim 1 wherein said dielectric member includes a flange extending forwardly to insulate said conductive shell from a panel at a cutout thereof upon mounting of said connector and said capacitive coupling assembly to said panel with said front conductive sheet adjacent said panel.

3. The connector as set forth in claim 1 wherein said dielectric member includes an aperture through which said connector is disposed, and further includes relief openings along said aperture into which free ends of said spring arms are deflected upon assembly of said connector to said capacitive coupling assembly and engagement of said spring arms against outer surfaces of said connector shell thereby deflecting said spring arms outwardly.

4. A capacitive coupling for interposition between an electrical connector and an electrical equipment panel, the capacitive coupling comprising:

a dielectric member which is sandwiched between front and rear conductive sheets, the dielectric member holding at least one capacitor which is operably connected to effect a capacitance between the conductive sheets, said dielectric member including a flange extending forwardly to insulate a conductive shell of said connector from a panel at a cutout thereof upon mounting of said connector and said capacitive coupling assembly to said panel with said front conductive sheet adjacent said panel.

5. The capacitive coupling as set forth in claim 4 wherein said dielectric member includes an aperture through which said connector is disposed, spring arms of said rear conductive sheet extend forwardly and into said aperture from an inner peripheral edge of said rear conductive sheet, and said dielectric member further includes relief openings along said aperture into which free ends of said spring arms are deflected upon assembly of said connector to said capacitive coupling assembly and engagement of said spring arms against outer surfaces of a conductive shell of said connector thereby deflecting said spring arms outwardly.

* * * * *